United States Patent [19]

Tanaka et al.

[11] Patent Number: 4,975,745

[45] Date of Patent: Dec. 4, 1990

[54] ELECTROPHOTOGRAPHIC PHOTOSENSITIVE MEMBER

[75] Inventors: Hisami Tanaka, Yokohama; Hideo Kawahara, Ibaraki, both of Japan

[73] Assignee: Canon Kabushiki Kaisha, Tokyo, Japan

[21] Appl. No.: 372,178

[22] Filed: Jun. 27, 1989

Related U.S. Application Data

[63] Continuation of Ser. No. 173,470, Mar. 25, 1988, abandoned.

[30] Foreign Application Priority Data

Mar. 30, 1987 [JP] Japan ..... 62-78212

[51] Int. Cl.[5] ..... G03G 15/00; G03G 5/09

[52] U.S. Cl. ..... 355/211; 430/58

[58] Field of Search ..... 355/211, 212; 430/56, 430/57, 59

[56] References Cited

U.S. PATENT DOCUMENTS

| | | | |
|---|---|---|---|
| 4,258,113 | 3/1981 | Kuehnle | 430/94 |
| 4,359,514 | 11/1982 | Shimizu et al. | 430/65 |
| 4,415,641 | 11/1983 | Goto et al. | 430/58 X |
| 4,439,507 | 3/1984 | Pan et al. | 430/59 |
| 4,471,040 | 9/1984 | Katagiri et al. | 430/58 X |
| 4,489,147 | 12/1984 | Chang | 430/58 |
| 4,496,236 | 1/1985 | Beaudet et al. | 355/3 DR |
| 4,501,808 | 2/1985 | Sakai et al. | 430/59 |
| 4,551,406 | 11/1985 | Schaeduch et al. | 430/119 |

*Primary Examiner*—Arthur C. Prescott

*Attorney, Agent, or Firm*—Fitzpatrick, Cella, Harper & Scinto

[57] ABSTRACT

An electrophotographic photosensitive member has a photosensitive layer containing a photoconductive pigment dispersed in a resin and for forming an image according to the reversal developing system, characterized in that:

said resin contains an acrylic resin having the structural unit represented by the formula:

(1)

(wherein $R_1$ and $R_2$ each represent an alkyl group, an aralkyl group or an aryl group.

14 Claims, No Drawings

ELECTROPHOTOGRAPHIC PHOTOSENSITIVE MEMBER

This application is a continuation of application Ser. No. 173,470 filed Mar. 25, 1988, now abandoned.

BACKGROUND OF THE INVENTION

1. Field of the Invention

This invention relates to an electrophotographic photosensitive member for forming an image according to the reversal developing system.

2. Related Background Art

As the photoconductive material of electrophotographic photosensitive member, in place of inorganic photoconductive members of the prior art, various organic photoconductive members have been developed in recent years, and particularly the function separation type electrophotographic photosensitive member having a photosensitive layer comprising a charge generation layer and a charge transport layer laminated has been already practically applied.

The charge generation layer is a layer comprising a resin having a photoconductive pigment dispersed therein, and, for example, those containing a photoconductive material such as azo pigment, perylene pigment, phthalocyanine pigment, squarilium type pigment, etc. dispersed in a resin such as styrene resin, styrene-butadiene copolymer, polycarbonate resin, vinyl butyral resin, etc. have been known.

When an image is formed according to the reversal developing system by use of an electrophotographic photosensitive member having such a charge generation layer having a photoconductive pigment dispersed in the resin and a charge transport layer laminated, ground fog is liable to be generated on the white tone image, and image defect such as black dot will be increased, when successive copying is conducted repeatedly.

Such image defect is not a problem in the positive developing system but a phenomenon particularly conspicuous in the reversal developing system.

For example, when an electrophotographic photosensitive member using a charge transport layer having a perylene pigment dispersed in a butyral resin is employed in the reversal developing system, black dots are outstanding on white tone image.

When an electrophotographic photosensitive member using a charge generation layer having a disazo pigment dispersed in a polycarbonate resin is employed in the reversal developing system, ground fog is generated on white tone image, and density lowering will be generated due to increase of residual potential when successive copying is conducted repeatedly.

On the other hand, when an electrophotographic photosensitive member using a charge generation layer having a phthalocyanine pigment dispersed in an epoxy resin is employed in the reversal developing system, ground fog is generated on white tone image, and black dots are increased when successive copying is conducted repeatedly.

Thus, in the case of forming an image according to the reversal developing system, no electro-photographic photosensitive member excellent in repetition stability in electrophotographic characteristics in repeated use has been found yet under the present situation.

SUMMARY OF THE INVENTION

An object of the present invention is to provide an electrophotographic photosensitive member to be used in the reversal developing system, which has high sensitivity, high durability and no image defect.

Another object of the present invention is to provide an electrophotographic photosensitive member having various photoconductive pigments uniformly dispersed and also a uniform coating formed thereon.

According to the present invention there is provided an electrophotographic photosensitive member having a photosensitive layer containing a photoconductive pigment dispersed in a resin and for forming an image according to the reversal developing system, characterized in that:

said resin contains an acrylic resin having the structural unit represented by the formula:

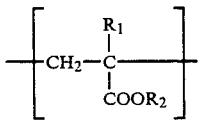

(1)

In the above formula, $R_1$ and $R_2$ each represent an alkyl group, an aralkyl group or an aryl group, and the alkyl group may include methyl, ethyl and the like; the aralkyl group benzyl, phenethyl and the like; the aryl group phenyl, etc. These groups may also have substituents.

The acrylic resin containing the photoconductive pigment in the present invention has extremely good dispersion stability, having also high volume resistivity as well as good insulating property, whereby local irregularity of potential will hardly occur. For this reason, it may be considered that irregularlity of potential in dark place is little when a photosensitive member is produced, and fogging or black dot which is the image defect will be generated with difficulty.

Generally speaking, in the developing process, the proportion of the local irregularity in the photosensitive member will affect directly at the same proportion the light place potential and the dark place potential. Accordingly, the dark place potential having larger potential than the light place potential irregularity will become relatively by far greater as compared with the light place potential. Such large potential irregularity of dark place potential becomes particularly conspicuous as the image defect such as ground fog in the reversal developing system.

In other words, when the developing method is the reversal developing system, since white tone image is developed by dark place potential with large potential irregularity, a large number of image defects such as ground fog caused by such potential irregularity will be generated. In the case of the positive developing system, since white tone image is developed by light place potential with relatively smaller potential irregularity, image defect will be generated with difficulty. Accordingly, in the reversal developing system in which ground fog is particularly conspicuous, the photosensitive member according to the present invention exhibits excellent characteristics.

The above acrylic resin is a polymer of an acrylic monomer having the structural units of the above formula (1) or a copolymer with another monomer, and acrylic acid and methacrylic acid are not preferred, because polymers of such monomers are hygroscopic under highly humid conditions. On the other hand, polymers with bulky structures such as of tert-butyl methacrylate, n-octyl methacrylate are not preferred, because the photosensitive member is softened. From these points, $R_1$ may be preferably a lower alkyl group, and $R_2$ may be preferably a lower alkyl, aralkyl or aryl group, particularly methyl or ethyl, and $R_2$ may be preferably methyl, ethyl, benzyl or phenyl group.

As other monomers, there may be included styrene, vinyl acetate, butadiene, ethylene, propylene, vinyl chloride, etc. The composition ratio of the copolymer may be 50% by weight or more, preferably 80% by weight or more, of the formula (1). If the composition ratio is less than 50% by weight, the effects of high durability, high image quality are not sufficient, and susceptible to the influences from other monomers.

The resin of the present invention has a number average molecular weight of 1,000 to 80,000, preferably 2,000 to 50,000. If the number average molecular weight is less than 1,000, the resin is brittle, whereby cracks, etc. are liable to be formed on the photosensitive member. If the number average molecular weight exceeds 80,000, the coating material becomes to have too high viscosity, whereby production becomes practically difficult.

As the photoconductive pigment to be used to the present invention, there may be included organic photoconductive materials, including the perylene pigments as disclosed in U.S. Patent 3,871,882, etc.; azo pigments such as disazo, trisazo pigments as disclosed in U.S. Patents 4,390,611, 4,551,404, Japanese Laid-open Patent Applications Nos. 55643/1975, 656/1982, etc.; cyanine pigments as disclosed in Japanese Laid-open Patent Applications Nos. 42055/1973, 58554/1973, etc.; phthalocyanine pigments with the center metal of hydrogen atom, deuterium, sodium, potassium, copper, silver, berillium, magnesium, calcium, zinc, cadmium, barium, mercury, aluminum, gallium, iridium, lanthanum, neodium, samarium, europium, cadmium, lutetium, titanium, tin, molybdenum, manganese, cobalt, nickel, palladium, etc. as disclosed in Japanese Patent Publications Nos. 2780/1965, 8102/1970, 11021/1980, etc. Particularly, as the photoconductive pigment to be used for semiconductor laser beam printer, those having longer wavelength absorptions of visible light of 600 nm or longer may be employed.

For example, as perylene pigment, disazo pigment, trisazo pigment, phthalocyanine pigment, those having the following structures may be included.

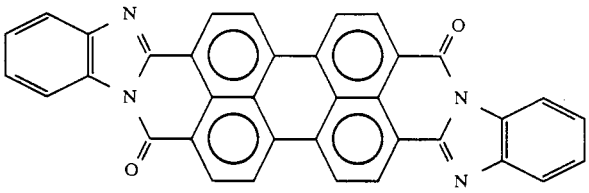

(1)

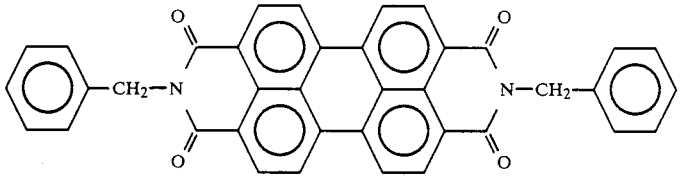

(2)

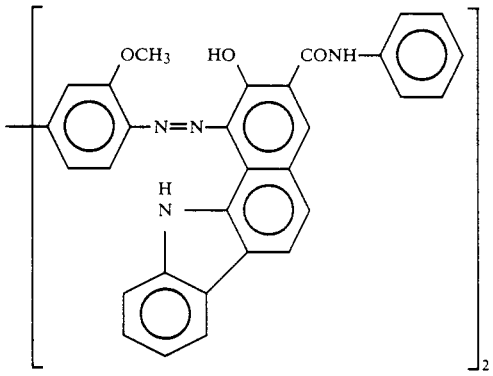

(3)

-continued
(4)
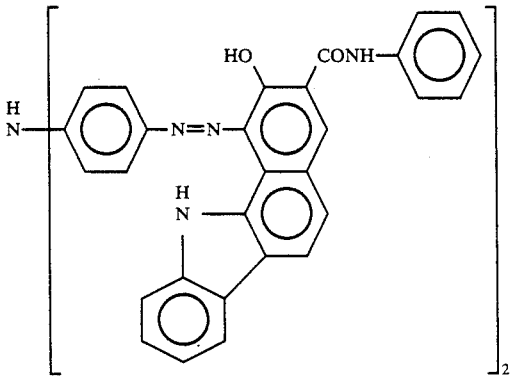
(5)
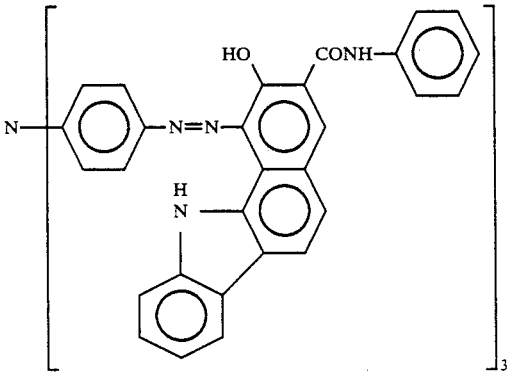
(6)
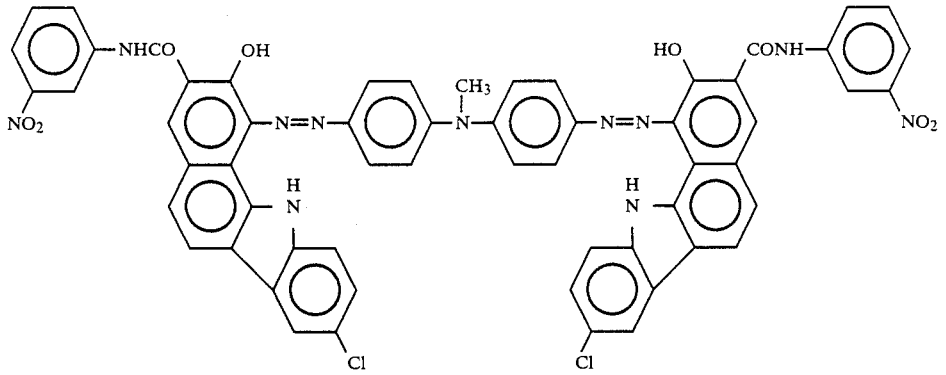
(7)
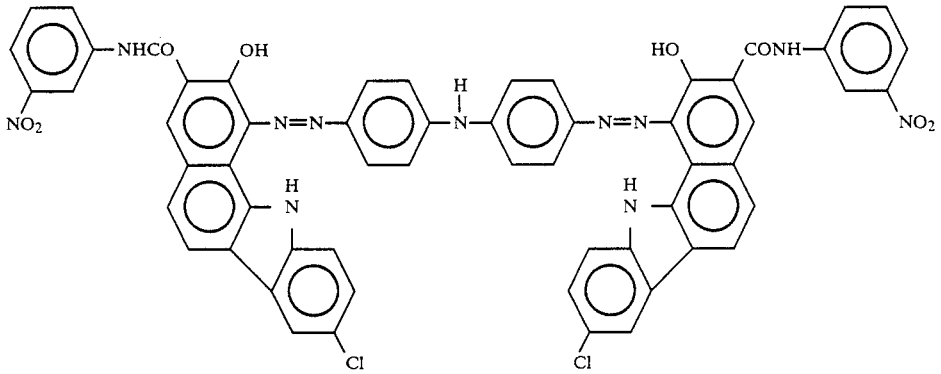

-continued (8)

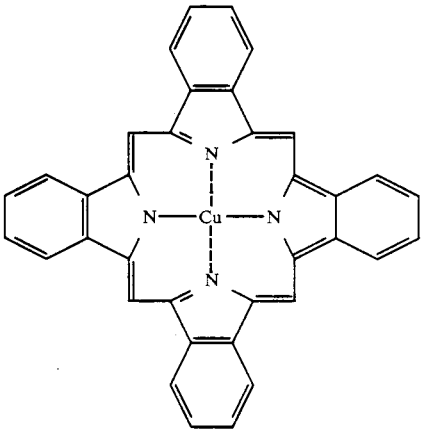

As the support to be used in the present invention, various electroconductive supports can be used such as supports of which the support itself has electroconductivity such as aluminum, or supports obtained by vapor deposition or lamination of a metal such as palladium, copper, iron, nickel, stainless steel, gold, silver, tin, zinc, etc. or a metal oxide such as tin oxide, etc., or supports obtained by coating of a layer having electroconductive fine powder of the above metal, metal oxide or carbon black, etc. dispersed in the resin.

Also, in the present invention, an intermediate layer comprising casein, polyvinyl alcohol, ethyl cellulose or vinyl acetate, etc. can be provided, if desired, between the electroconductive support and the photosensitive layer for the purpose of improving adhesiveness of the above support to the photosensitive member or electrostatic characteristics of the photosensitive layer.

For forming the photosensitive layer of the present invention, after the photoconductive pigment and the resin of the present invention are dispersed together with an organic solvent such as methyl ethyl ketone, acetone, halogenated hydrocarbon, toluene, tetrahydrofuran, cyclohexanone, etc. by means of a dispersing means such as sand mill, the dispersion is coated onto the electroconductive support, followed by drying. The mixing ratio may be 0.01 to 100 parts by weight, preferably 0.1 to 10 parts by weight, of the resin of the present invention per 1 part by weight of the photoconductive pigment.

When the photosensitive layer is the laminated type of a charge generation layer and a charge transport layer, the photoconductive layer having the photoconductive pigment dispersed in the resin of the present invention is used as the charge generation layer.

In the case of an electrophotographic photosensitive member with a structure having a charge generation layer formed on the electroconductive support and a charge transport layer laminated thereon, the thickness of the charge generation layer may be 0.01 to 5 μm, preferably 0.05 to 2 μm, and the proportion of the photoconductive pigment in the charge generation layer may be 10 to 90% by weight, preferably 30 to 80% by weight based on the total weight.

The charge transport layer may be formed by dissolving a charge transporting substance and a binder resin in an appropriate solution, and coating the support with the resultant solution.

The charge transport layer provided on the charge generation layer may be formed by dissolving a charge transporting substance, for example, a compound having in the main chain or the side chain a polycyclic aromatic compound such as anthracene, pyrene, phenanthrene, coronene, etc.,.a nitrogen containing structure such as indole, carbazole, oxazole, isooxazole, thiazole, imidazole, pyrazole, oxadiazole, pyrazoline, thiadiazole, triazole, etc., a stilbene compound, a hydrazone compound, etc. in a resin having film forming property. This is because the charge transporting substance has generally lower molecular weight and is itself poor in film forming property.

Here, the proportion of the charge transporting substance contained in the charge transport layer may be 10 to 80% by weight, preferably 25 to 75% by weight, and its film thickness may be 5 to 40 μm, preferably 10 to 20 μm.

As the binder resin for the charge transport layer, there may be included polycarbonate resin, polyester resin, polystyrene resin, polyurethane resin, epoxy resin, acrylic resin, silicon resin and copolymers thereof, and these may be used individually or as a mixture of two or more kinds.

For the purpose of improving flexibility or durability etc. various additives can be added in the charge transport layer. Examples of the additives to be used for this purpose may include halogenated paraffin, dialkylphthalate, silicon oil, etc.

In the electrophotoconductive photosensitive member of the present invention, the photosensitive member having a photoconductive pigment dispersed in the resin may be also made the charge generation layer to be formed on the charge transport layer. In this case, for formation of the charge generation layer, the charge transporting substance as described above should preferably be added in order to make the film thickness more or less thicker. Further, in the electrophotographic photosensitive member, the photosensitive layer may be also a single layer containing the charge generating substance which is the photoconductive pigment and the charge transporting substance in the resin as the same layer.

In the photosensitive member of the present invention, if desired, an intermediate layer may be provided between the charge generation layer and the charge transport layer, and an overcoat layer on the charge transport layer.

EXAMPLE 1

A dispersion of a perylene pigment was obtained by dispersing 2 parts (hereinafter parts by weight) of a perylene pigment of the above formula (1) and 1 part of an acrylic resin (number average molecular weight 50,000) of the following formula:

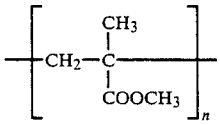

in a sand mill together with 97 parts by weight of cyclohexanone.

For preparation of a photosensitive member, an aluminum cylinder with an outer diameter of 60 mm was used, and first 10 parts of a nylon resin Amilan M-8000 produced by Toray Co.) in 90 parts of n-butanol and the solution was coated by dipping onto the aluminum cylinder, and dried by heating to provide a subbing layer of 1.0 μm thereon.

Next, the previous perylene pigment dispersion was coated by dipping onto the subbing layer and dried by heating to provide a charge generation layer of 0.2 μm.

Next, on the charge generation layer was coated a solution of 10 parts of a hydrazone compound of the following formula:

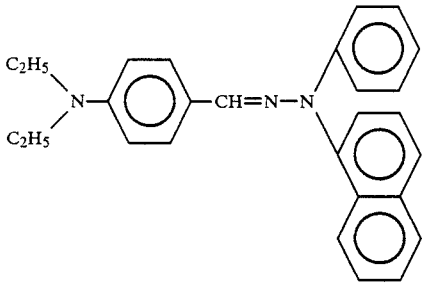

and 10 parts of a polycarbonate (Panlite L-1250, produced by Teijin Kasei Co.) dissolved in 70 parts of 1,2-dichloroethane and dried by heating to obtain a charge transport layer of 15 μm.

Thus, an electrophotographic photosensitive member having a photoconductive layer on an aluminum cylinder was prepared.

This photosensitive member was mounted on a reversal developing system laser beam printer (produced by Canon Co.), and potential characteristics and image characteristics before and after printing was repeated for 5000 times were observed.

COMPARATIVE EXAMPLE 1

An electrophotographic photosensitive member was prepared according to the same method except for using a butyral resin S-LEC BL-S, produced by Sekisui Kagaku) in place of the acrylic resin in the dispersion of the perylene pigment in Example 1.

The potential characteristics and the image characteristics are shown in Table 1.

EXAMPLE 2

A dispersion of a disazo pigment was obtained by dispersing 2 parts of a disazo pigment Chlorocyan Blue and 1 part of a polymethyl methacrylate-polybutyl acrylate (copolymerization ratio 90:10, number average molecular weight 40,000) together with 97 parts of cyclohexanone in a sand mill.

An electrophotographic photosensitive member was prepared according to the same method as in Example 1 except for using a dispersion of a disazo pigment in place of the perylene pigment as the charge generation layer.

The potential characteristics and the image characteristics are shown in Table 1.

COMPARATIVE EXAMPLE 2

An electrophotographic photosensitive member was prepared according to the same method as in Example 2 except for using a polycarbonate (Panlite L-1250, produced by Teijin Kasai) in place of the acrylic resin in the dispersion of the disazo pigment in Example 2.

The potential characteristics and the image characteristics are shown in Table 1.

EXAMPLE 3

A dispersion of copper phthalocyanine pigment was obtained by dispersing 2 parts of ϵ-type copper phthalocyanine (produced by Toyo Ink, ERPC) and 1 part of an acrylic resin (number average molecular weight 60,000) of the following formula:

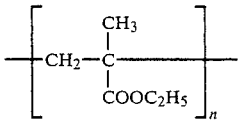

together with cyclohexanone in a sand mill.

An electrophotographic photosensitive member was prepared according to the same method as in Example 1 except for using a dispersion of copper phthalocyanine in place of the perylene pigment as the charge generation layer.

The potential characteristics and the image characteristics are shown in Table 1.

COMPARATIVE EXAMPLE 3

An electrophotographic photosensitive member was prepared according to the same method as in Example 3 except for using an epoxy resin (Epicoat 1001, produced by Shel Chemical Co.) in place of the acrylic resin in the dispersion of copper phthalocyanine in Example 3.

The potential characteristics and the image characteristics are shown in Table 1.

EXAMPLE 4

A dispersion of a photoconductive pigment was obtained by dispersing 2 parts of a disazo pigment of the above exemplary structural formula (6) and 1 part of an acrylic resin (number average molecular weight 10,000) of the following structural formula:

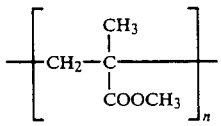

together with 97 parts of cyclohexanone in a sand mill.

An electrophotographic photosensitive member was prepared according to the same method as in Example 1 except for using the dispersion of the photoconductive pigment in place of the perylene pigment as the charge generation layer.

The potential characteristics and the image characteristics are shown in Table 1.

COMPARATIVE EXAMPLE 4

An electrophotographic photosensitive member was prepared according to the same method as in Example 4 except for using a polyacrylic acid (number average molecular weight 10,000) in place of the acrylic resin in the dispersion of the photoconductive pigment in Example 4.

The potential characteristics and the image characteristics are shown in Table 1.

EXAMPLE 5

A dispersion of a photoconductive pigment was obtained by dispersing 2 parts of a trisazo pigment of the above exemplary structural formula (5) and an acrylic resin (number average molecular weight 50,000) of the following structural formula:

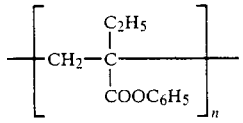

together with 97 parts of cyclohexanone in a sand mill.

An electrophotographic photosensitive member was prepared according to the same method as in Example 1 except for using the dispersion of the photoconductive pigment in place of the perylene pigment as the charge generation layer.

The potential characteristics and the image characteristics are shown in Table 1.

EXAMPLE 6

A dispersion of a photoconductive pigment was obtained by dispersing 2 parts of a disazo pigment of the above exemplary structural formula (4) and an acrylic resin (number average molecular weight 50,000) of the following structural formula:

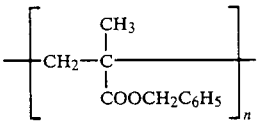

together with 97 parts of cyclohexanone in a sand mill.

An electrophotographic photosensitive member was prepared according to the same method as in Example 1 except for using the dispersion of the photoconductive pigment in place of the perylene pigment as the charge generation layer.

The potential characteristics and the image characteristics are shown in Table 1.

TABLE 1

| | Initial potential (Exposure dosage 3.0 μJ/cm²) | | After repeated for 50000 times (Exposure dosage 3.0 μJ/cm²) | | |
|---|---|---|---|---|---|
| | Dark place | After exposure | Dark place | After exposure | Image characteristics |
| Example 1 | −700 V | −180 V | −690 V | −170 V | no fog, high image quality after 50000 times |
| Comparative example 1 | −690 V | −230 V | −500 V | −350 V | fog present, black dot generated after 1000 times |
| Example 2 | −710 V | −185 V | −700 V | −190 V | no fog, high image quality after 50000 times |
| Comparative example 2 | −705 V | −280 V | −550 V | −380 V | fog present, image density lowered after 1000 times |
| Example 3 | −700 V | −185 V | −710 V | −195 V | no fog, high image quality after 50000 times |
| Comparative example 3 | −695 V | −250 V | −450 V | −240 V | fog present, black dot generated after 1000 times |
| Example 4 | −690 V | −190 V | −700 V | −180 V | no fog, high image quality after 50000 times |
| Comparative example 4 | −710 V | −220 V | −300 V | −120 V | fog present, black dot generated after 1000 times |
| Example 5 | −710 V | −190 V | −700 V | −185 V | no fog, high image quality after 50000 times |
| Example 6 | −705 V | −180 V | −690 V | −190 V | no fog, high image quality after 50000 times |

As described above, the electrophotographic photosensitive member according to the present invention, when forming an image according to the reversal developing system, can obtain an excellent image without image defect such as fogging, black dot, etc. and high image quality can be obtained after successive copying for 50,000 times.

What is claimed is:

1. An electrophotographic photosensitive member having a photosensitive layer containing a photoconductive pigment dispersed in a resin and for forming an image according to the reversal developing system, characterized in that:

said resin contains an acrylic resin having the structural unit represented by the formula:

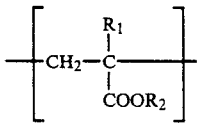

(1)

(wherein $R_1$ and $R_2$ each represent an alkyl group, an aralkyl group or an aryl group.

2. An electrophotographic photosensitive member according to claim 1, wherein $R_1$ is a lower alkyl group and $R_2$ is a lower alkyl group, an aralkyl group or an aryl group.

3. An electrophotographic photosensitive member according to claim 1, wherein $R_1$ is methyl, ethyl and $R_2$ is methyl, ethyl, benzyl or phenyl.

4. An electrophotographic photosensitive member according to claim 1, wherein the photoconductive pigment is an organic photocondutive material.

5. An electrophotographic photosensitive member according to claim 4, wherein the photoconductive pigment is a perylene pigment.

6. An electrophotographic photosensitive member according to claim 4, wherein the photoconductive pigment is an azo pigment.

7. An electrophotographic photosenstiive member according to claim 4, wherein the photoconductive pigment is a phthalocyanine pigment.

8. An electrophotographic photosensitive member according to claim 1, wherein the electrophotographic member has a laminated structure of a charge generation layer and a charge transport layer, and the photosensitive layer containing said photoconductive pigment dispersed therein is the charge generation layer.

9. An electrophotographic photosensitive member according to claim 2, wherein the electrophotographic member has a laminated structure of a charge generation layer and a charge transport layer, and the photosensitive layer containing said photoconductive pigment dispersed therein is the charge generation layer.

10. An electrophotographic photosensitive member according to claim 3, wherein the electrophotographic member has a laminated structure of a charge generation layer and a charge transport layer, and the photosensitive layer containing said photoconductive pigment dispersed therein is the charge generation layer.

11. An electrophotographic photosensitive member according to claim 4, wherein the electrophotographic member has a laminated structure of a charge generation layer and a charge transport layer, and the photosensitive layer containing said photoconductive pigment dispersed therein is the charge generation layer.

12. An electrophotographic photosensitive member according to claim 5, wherein the electrophotographic member has a laminated structure of a charge generation layer and a charge transport layer, and the photosenstiive layer containing said photoconductive pigment dispersed therein is the charge generation layer.

13. An electrophotographic photosensitive member according to claim 6, wherein the electrophotographic member has a laminated structure of a charge generation layer and a charge transport layer, and the photosensitive layer containing said photoconductive pigment dispersed therein is the charge generation layer.

14. An electrophotographic photosensitive member according to claim 7, wherein the electrophotographic member has a laminated structure of a charge generation layer and a charge transport layer, and the photosensitive layer containing said photoconductive pigment dispersed therein is the charge generation layer.

* * * * *